United States Patent [19]

Godbe et al.

[11] Patent Number: 4,973,092

[45] Date of Patent: Nov. 27, 1990

[54] CLOSURE CLASP

[76] Inventors: Anthony L. R. Godbe, 1794 Logan Ave., Salt Lake City, Utah 84108; Hampton Godbe, 1353½ Glenmare St., Salt Lake City, Utah 84105; Betty G. Walker, 1794 Logan Ave., Salt Lake City, Utah 84108

[21] Appl. No.: 306,878

[22] Filed: Feb. 3, 1989

Related U.S. Application Data

[63] Continuation-in-part of Ser. No. 112,491, Oct. 26, 1987, abandoned.

[51] Int. Cl.[5] ..... E05C 3/14

[52] U.S. Cl. ..... 292/190; 292/241

[58] Field of Search ..... 24/643; 292/DIG. 10, 292/DIG. 11, DIG. 48, DIG. 50, 240, 241, 242, 190

[56] References Cited

U.S. PATENT DOCUMENTS

| | | | |
|---|---|---|---|
| 120,192 | 10/1871 | Greenough | 292/240 |
| 135,873 | 2/1873 | Youngblood | 292/240 |
| 217,146 | 7/1979 | Quackenbush . | |
| 312,195 | 2/1985 | Ford . | |
| 423,607 | 3/1890 | Hunt . | |
| 532,067 | 1/1895 | Howe . | |
| 617,582 | 1/1899 | Kuhn . | |
| 1,257,051 | 2/1918 | Thomas et al. . | |
| 2,267,704 | 12/1941 | Abel | 292/241 |
| 3,306,644 | 2/1967 | Larsen | 292/241 |
| 3,690,708 | 9/1972 | Worley et al. | 292/101 |
| 3,811,718 | 5/1974 | Bates | 292/241 |
| 4,807,914 | 2/1989 | Fleming et al. | 292/240 |

FOREIGN PATENT DOCUMENTS

| | | | |
|---|---|---|---|
| 552300 | 11/1956 | Belgium | 292/241 |
| 159096 | 2/1940 | Fed. Rep. of Germany | 292/241 |
| 661959 | 8/1929 | France | 292/241 |
| 128153 | 5/1950 | Sweden | 292/241 |
| 10488 | of 1892 | United Kingdom . | |

*Primary Examiner*—Eric K. Nicholson

[57] ABSTRACT

A rotatable knob mounted at one side of an opening to a container has formed on the underside thereof a recess and a channel extending therefrom through the periphery of the knob. Opposite the knob on the other side of the container opening is secured a clasp. When the knob is rotated into its open position with the catch channel directed toward the catch, closure of the opposite sides of the container opening moves the catch through the catch channel to the recess on the underside of the knob. Thereafter, rotation of the knob in either direction out of its open position, captures the catch in the recess on the underside of the knob. Release of the catch is accomplished by rotating the knob back to its open position. In an alternative embodiment, the catch channel terminates short of the periphery of the knob, but a portion of the knob extends beyond the edge of the container opening. In the opening position of the knob with the catch channel oriented toward the catch, the catch channel also extends beyond the edge of the container opening. The catch is received in this overhanging portion of the catch channel to enter the recess on the underside of the knob by pivoting with its respective portion of the container about a point remote from the catch and knob.

10 Claims, 3 Drawing Sheets

CLOSURE CLASP

RELATED APPLICATIONS

This is a continuation-in-part application of U.S. patent application Ser. No. 07/112,491 filed on Oct. 26, 1987, and now abandoned.

BACKGROUND OF THE INVENTION

1. Field of the Invention

This invention relates to closure devices and more particularly to a clasp for releasably securing the opening to a container, such as a purse, a jewelry box, a suitcase, or a file for documents or collectibles. Taken in a somewhat broader aspect, the invention has potential applicability to the closure of larger containers, such as cupboards, mailboxes, cabinets, and even rooms, where the opening requiring closure takes the form of a window or door.

2. Background Art

Many approaches have been used to effect the secure closure of both small and large containers, such as those described above. One approach has involved the use of a fixed member or catch on one side of the opening to be secured and a moveable latch opposite thereto on the other side of the opening. Typically, the latch, which is rotatable in a plane parallel the outer surface of the container, is designed to pierce or seize the catch in order to effect the desired closure. In some instances, the latch includes complicated camming mechanisms which act upon the catch once captured and draw tightly closed the opposite edges of the opening involved.

In such known closure mechanisms, the rotation required of the latch to effect capture of the catch is in a single predetermined angular direction of rotation. This then necessitates a degree of experience with the clasping mechanism in order for a user to routinely operate the mechanism in an automatic manner.

When closure is effected in such closure mechanisms, the catch and the elements of the latch that seize it remain in an exposed condition. This can have a displeasing aesthetic consequence. Functionally, however, such exposed components tend to snag on other articles causing damage and risking the inadvertent unclasping of the closure mechanism. Where catch and latch are installed in opposed recesses in the mating edges of the opening to a container, the catch and latch may be concealed, but the complexity of the mechanism and its installation are substantially increased.

Typically, rotatable closure mechanisms of the type referred to employ protruding tabs, thumbpieces, spurs, and levers on the rotatable member. While these elements may enhance the ease by which an operator closes and opens the mechanism, they are features which increase the possibility of an unwanted release of the mechanism due to a chance impact or to snagging. To reduce the chances of this type of release, it is frequently necessary that the rotatable latch be made stiff to rotate, particularly in its closed position. Unhappily, such a solution to the problem of inadvertent releases only results in a mechanism which requires a significant threshold of force for its successful operation.

It is toward this end that a camming action is often incorporated into the rotatable latch. This is undertaken, however, at some cost to the simplicity of the structure of the latch and its ease of mounting to the container to be closed thereby.

SUMMARY OF THE INVENTION

One object of the present invention is to produce an improved clasp by which to effect closure of a container through the capture of a stationary catch by a latch structure rotatable in a plane parallel to the exterior of the container involved.

Another object of the present invention is to produce a clasp as described above in which the rotation of the latch which can give rise to capture of the catch is not limited in its angular direction.

Still another object of the present invention is a clasp as described above which conceals the stationary and moveable elements of the mechanism when closure is effected.

One more object of the present invention is a clasp as described above in which the latch portion thereof is free of projecting structures, such as tabs, thumbpieces, and levers, whereby the catch involved displays a streamlined aesthetic appearance and affords enhanced security from inadvertent releases due to snags or impacts upon such protrusions.

Yet another object of the present invention is to produce a clasp of extreme simplicity in design and installation, involving a minimum of parts.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects and in accordance with the invention as embodied and broadly described herein, a clasp for releasably securing first and second closing edges of the walls of a container is provided in one embodiment of the present invention with a catch fixed on the outside of the container adjacent the first closing edge and a knob rotatably mounted on the outside of the container adjacent the second closing edge at a position opposite the catch. The side of the knob adjacent to the container is substantially planar and has formed therein a centrally located recess and a radially disposed catch channel. The catch channel extends from the recess through the periphery of the knob. The knob itself is rotatable into an open position in which the catch channel is oriented towards the first closing edge of the container. In this open position, the catch is received by the catch channel and conducted thereby into the recess as the first closing edge moves into contact with the second closing edge. The recess on the side of the knob adjacent to the container has sidewalls so configured that when the catch is in the recess, the rotation of the knob out of its open position captures the catch within the recess, precluding separation of the first and second closing edges. Rotation of the knob for this purpose can occur in either angular direction from the open position.

In another preferred embodiment of the present invention adapted to be used to secure in a closed position the pivoted first and second portions of a container, a catch and a rotatably mounted knob are fixed on the outside of the first and second portions, respectively, of the container at edges thereof remote from the hinge. A portion of the knob projects beyond the edge of the container at which it is mounted, and the side of the knob adjacent to the container has formed therein a centrally located recess for capturing the catch and a radially disposed catch channel which extends outwardly from the recess to a point interior of the periphery of the knob.

The knob may be rotated into an open position in which the catch channel is oriented toward the catch and extends beyond the container edge at which the knob is mounted. When the first and second portions of the container are pivoted for the purpose of closing the container, the catch enters the catch channel and passes into the recess. Subsequently, rotation of the knob into a position out of the open position captures the catch within the recess and catch channel to preclude opening of the container.

Preferably, a clasp for securing the opening of a container is provided comprising a rotatable disk mounted on one side of the opening; a centrally located circular cavity formed in the underside of the disk; a slot formed through the periphery of the disk into the cavity; and a catch fixed to the side of the opening opposite the disk. The disk has an open position in which the slot is directed towards the catch, and the catch is received into the cavity through the slot as the container is closed. Rotation of the disk out of its open position then captures the catch within the cavity. Rotation of the disk to capture or to release the catch can occur in either direction.

BRIEF DESCRIPTION OF THE DRAWINGS

In order that the manner in which the above-recited and other advantages and objects of the invention are obtained, a more particular description of the invention briefly described above will be rendered by reference to specific drawings. Understanding that these drawings depict only typical embodiments of the invention and are therefore not to be considered limiting of its scope, the invention will be described with additional specificity and detail through the use of the accompanying drawings, in which.

DESCRIPTION OF THE PREFERRED EMBODIMENTS

Figure 1:
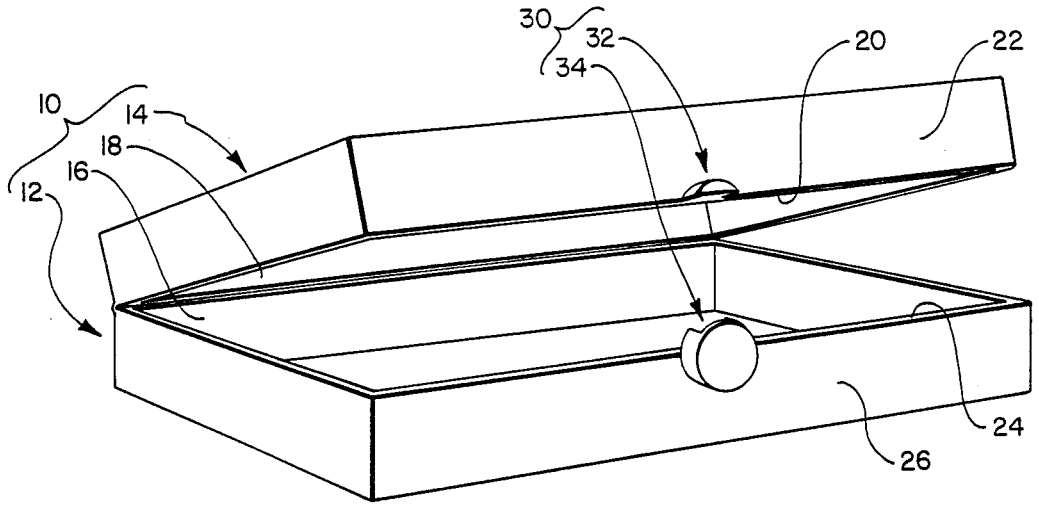
FIG. 1 is a perspective view of a first embodiment of a clasp incorporating teachings of the present invention and mounted on the walls of a container.

In FIG. 1 is shown a selectively openable container 10 having a lower receptacle portion 12 and a lid 14 corresponding thereof. Receptacle portion 12 and lid 14 are hinged together at edges 16, 18, respectively. This configuration of the components of container 10 defines a first closing edge 20 of a wall 22 at the side of lid 14 remote from hinged edge 18 thereof. Similarly, a second closing edge 24 of a wall 26 is located remote from hinged edge 16 of receptacle portion 12.

As shown in FIG. 1, container 10 is provided with a clasp 30 incorporating teachings of the present invention for releasably securing first closing edge 22 and second closing edge 24. Clasp 30 comprises a catch 32 and a knob 34. Catch 32 is fixed on the outside of wall 22 adjacent first closing edge 20. Knob 34 is rotatably mounted on the outside of wall 26 adjacent closing edge 24 thereof at a position that is opposite catch 32 when lid 14 and receptacle portion 12 are pivoted about the hinged edges 16, 18 to close container 10.

While container 10 has a receptacle portion and lid which are hinged, it is well within the capability of a clasp, such as clasp 30, to effect the releasable securing of closing edges of walls of a container in which the receptacle portion and lid are completely detachable from one another. In such a case, it would only be necessary to provide two or more clasps, such as clasp 30, suitably located about the periphery of the opening between the receptacle portion and lid.

Figure 2:
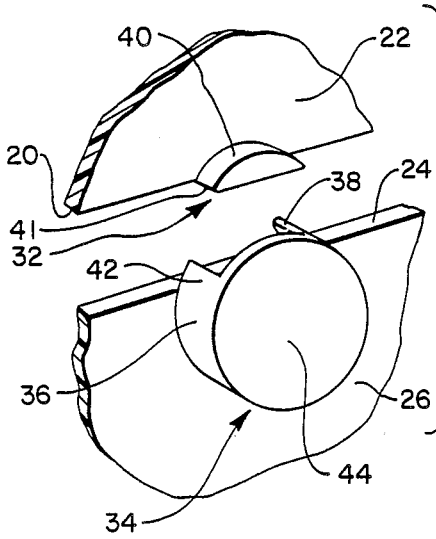
FIG. 2 is a detail view of the catch and knob of the clasp of FIG. 1 shown in close proximity to each other with the knob in the open position thereof.

The opposing position of catch 32 relative to knob 34 is more readily appreciated by reference to FIG. 2. There it can be seen that as first closing edge 20 carrying catch 32 approaches second closing edge 24, the two components of clasp 30 are brought into engagement with each other.

Knob 34 has curving peripheral sides 36 that are normal to wall 26. While being depicted as being a disc of generally cylindrical shape, knob 34 may assume any alternative shape that is capable of permitting the functional requisites of the present invention to be effected. Thus, a knob of the present invention could alternatively be configured as a regular or irregular polygon, or as any other decorative shape. The sides of such an alternative knob need not necessarily be normal to the outside of the container on which that knob is mounted.

As will be more fully disclosed in relation to subsequent figures, a centrally located cavity is formed in the underside of knob 34 that is adjacent to container 10. A slot 38 is shown in FIG. 2 as being formed through peripheral side 36 of knob 34 into the cavity. Slot 38 functions as the radially remote terminus of a catch channel that extends from the cavity in knob 34 through the periphery thereof.

Being rotatably mounted to wall 26, knob 34 in FIG. 2 has been rotated into an open position thereof in which slot 34 and the catch channel associated therewith are oriented towards first closing edge 14 and catch 32 mounted thereon. In the open position of knob 34, catch 32 is receivable in slot 38 and through the catch channel associated therewith into the recess on the underside of knob 34 when first closing edge 20 is moved into contact with second closing edge 24. This relationship of the elements of clasp 30 and container 10 is shown in perspective in FIG. 3.

Figure 3:
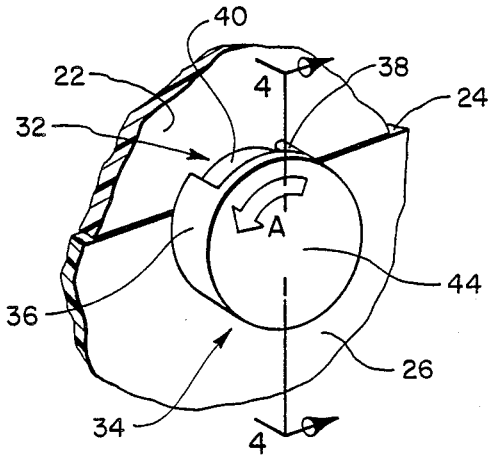
FIG. 3 is a perspective detail view of the clasp shown in FIG. 1 with the knob thereof in its open position and the catch thereof received within the knob.

In the embodiment of the invention illustrated in FIGS. 2 and 3 catch 32 is a relatively broad projection from wall 22 having a curved upper surface 40 and a lower surface 41 terminating at the level of first closing edge 20. These aspects of catch 32 are not, however, required by the inventive clasp as broadly disclosed herein. Alternatively, catch 32 could be a relatively narrow post-like projection or stud. In this case, the width of slot 34 could be narrowed from that shown in FIGS. 2 and 3 accordingly.

Similarly, the amount by which the knob of the present invention extends beyond second closing edge 24 at which it is mounted depends to a major extent upon the structure of the catch with which that knob is to cooperate. In the embodiment of the present invention shown in FIGS. 2 and 3 a projecting portion 42 of knob 34 extends beyond second closing edge 24 toward first closing edge 20. Accordingly, when first and second closing edges 20, 24, respectively, are in contact, as in FIG. 3, projecting portion 42 of knob 34 overlies wall 22 of lid 14. In this fashion, catch 32, which is secured at the portion of wall 22 overlain by projecting portion 42 of knob 34, comes to be disposed behind knob and the upper surface 44 thereof. To the extent that catch 32 is made to depend downwardly from wall 22, so that catch 32 projects beyond first closing edge 20, then knob 34 can be located lower on wall 26 and still receive catch 32 therein when first and second closing edges 20, 24, respectively, are in contact. Such an arrangement is considered to be within the scope of the present invention.

A better understanding of the interaction of catch 32 and knob 34 to secure closure of container 10 can be derived through an examination of FIGS. 4 through 8.

Figure 4:
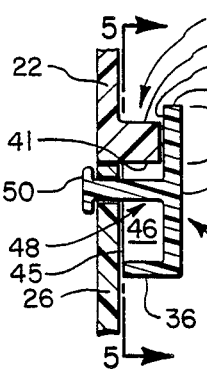
FIG. 4 is a cross-sectional elevation view of the clasp shown in FIG. 3 taken along section line 4—4 therein.

In FIG. 4 it will be seen that the side 45 of knob 34 adjacent to wall 26 has formed therein a cavity or recess 46 into which catch 32 is received by way of slot 38 when catch 32 and knob 34 are in the relative position depicted in FIG. 3. While peripheral sides 36 of knob 34 as shown in FIG. 4 are relatively thin, in instances where the radius of knob 34 substantially exceeds the radius required to contain recess 46, peripheral sides 36 will exhibit additional thickness. Under such circumstances, projecting portion 42 of knob 34 will extend further beyond the second closing edge 24 than is shown in FIG. 4, and slot 38 will necessarily function as the radially extreme end of a channel leading from the outer surface of peripheral side 36 into recess 46.

Knob 34 is secured to wall 26 by means of a pin 48 that passes through recess 46 and defines of the center of rotation of knob 34. If formed of a thermoplastic material, pin 48 may be heated into an enlarged retaining head 50 on the side of wall 26 opposite from knob 34 in order to retain knob 34 in position. Alternative structures for rotatably securing a knob, such as knob 34, in this manner are known in the art and considered to be within the scope of the present invention.

Figure 5:
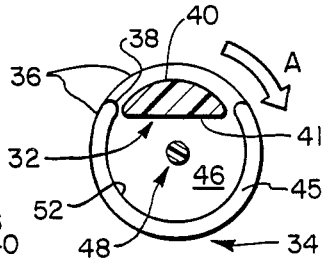
FIG. 5 is a cross-sectional elevation view of the clasp shown in FIG. 4 taken along section line 5—5 shown therein.

From FIG. 5, it will be appreciated that recess 46 is generally concentric with peripheral sides 36 of knob 34. Recess 46 has walls 52 that are generally circular and concentric with pin 48. The curvature shown in top surface 40 of catch 32 is thus required to enable walls 52 of recess 46 to pass above catch 32 whenever knob 34 is rotated out of the open position thereof to secure closure of container 10. Thus, in the position shown in FIG. 5, catch 32 is actually within recess 46, and catch 32 may thereafter be captured therewithin by the rotation of knob 34 in the direction shown in FIGS. 3 and 5 by arrow A. This will, for example, bring knob 34 and catch 32 into the relative positions illustrated in FIGS. 6 through 8.

Figure 6:
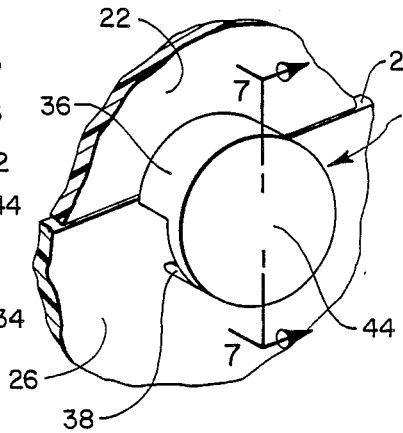
FIG. 6 is a perspective detail view of the clasp shown in FIG. 3 with the knob thereof rotated out of the closed position thereof.
Figure 7:
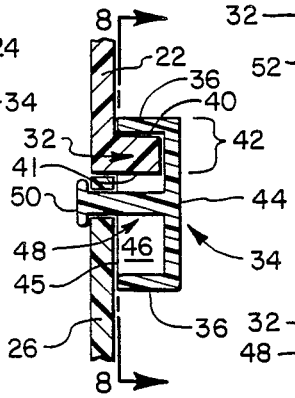
FIG. 7 is a cross-sectional elevation view of the clasp shown in FIG. 6 taken along section line 7—7 shown therein.

In FIGS. 6 and 7, it can be seen that such rotation of knob 34 has moved slot 38 away from top surface 40 of catch 32 to a lower side of knob 34. In this position, a portion of peripheral side 36 of knob 34 is placed directly above catch 32, thereby blocking removal of catch 32 from recess 46 in knob 34. Catch 32 is thus captured within recess 46 and the separation of first and second closing edges 20, 24 is impossible. The rotation of knob 34 in the opposite direction from that indicated in FIGS. 3 and 5 by arrow A would produce a somewhat similar result. From the open position of knob 34 shown in FIG. 3, the rotation of knob 34 in either direction therefrom will serve to secure closure of container 10, if at the beginning of the process catch 32 has passed through slot 38 and is disposed in recess 46.

Figure 8:
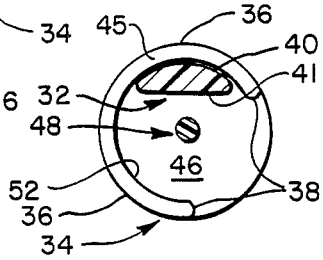
FIG. 8 is a cross-sectional elevation view of the clasp shown in FIG. 7 taken along section line 8—8 shown therein.

FIG. 8 enhances an understanding of the relationship among the structures involved. There, peripheral side 36 of knob 34 can be seen to overlie top surface 40 of catch 32, precluding its upward movement out of recess 46 and thus also effecting closure of container 10.

It will thus be observed that clasp 30 in the closed position thereof completely conceals catch 32 and all structures by which catch 32 is captured. With no protrusions on knob 34, such as levers, thumb pieces, or spurs, there is little possibility of accidentally releasing catch 32 by an accidental impact against knob 34. Closure is effected by rotation of knob 34 in either direction, and to release catch 32 it is only necessary to rotate knob 34 back into its open position with slot 38 above catch 32. This may be accomplished by rotating knob 34 in either direction. Finally, clasp 30 includes a minimum of separate parts, including a unitary knob 34 by which closure is effected. While it is conceivable that the elements of clasp 30 might be set in one or more recesses in the container with which it is used, in the form of the invention shown, all parts are easily mounted on the outside of container 10.

In clasp 30, the presence of slot 38 in peripheral side 36 of knob 34 detracts somewhat from the resistance of knob 34 to inadvertent opening. While knob 34 lacks substantial projections against which an accidental impact might cause rotation, it is conceivable that a stray impact catching the edge of slot 38 could move knob 34 into the open position thereof. One way to minimize this problem is to reduce the width of catch 32 and correspondingly the length of slot 38. In a second embodiment of the clasp incorporating teachings of the present invention, the need for a slot in the peripheral sides of the knob of the inventive clasp is eliminated entirely.

Figure 9:
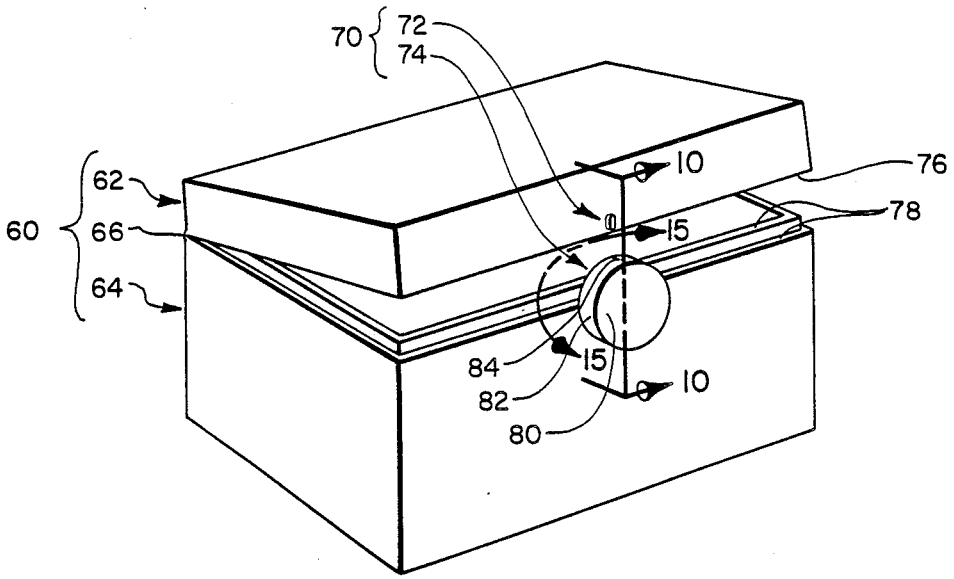
FIG. 9 is a perspective view of a second embodiment of a clasp incorporating teachings of the present invention and mounted on the exterior of a container.

Thus, in FIG. 9 is shown a selectively openable container 60 having a first portion 62 and a second portion 64 which are pivoted together at a common edge by a hinge 66. Container 60 is provided with a second embodiment of a clasp 70 incorporating teachings of the present invention. Clasp 70 is used to releasably secure first and second portion 62, 64, respectively, in a closed position. As shown by way of example and not limitation, clasp 60 comprises a catch 72 and a knob 74.

Catch 72 is fixed on the outside of first portion 62 of container 60 in a position at an edge 76 thereof that is remote from hinge 66. Knob 74, which in the embodiment illustrated takes the form of a generally cylindrical disk, is rotatably mounted on the outside of second portion 64 of container 60 at an edge 78 thereof remote from hinge 66. Knob 74 is so positioned along edge 78 as to face catch 72 when first and second portions 62, 64, respectively are in the closed position of container 60. Unlike the operation of clasp 30 shown in FIG. 1, correct operation of clasp 70 in FIG. 9 is premised upon the rotation of catch 72 on edge 76 about some remote pivot, such as hinge 66.

Knob 74 could be configured in any number of alternative shapes, but as shown in FIG. 9, comprises a flat top surface 80 and curving peripheral sidewalls 82 generally normal to container 60. In contrast to knob 34 of clasp 30, peripheral sidewalls 82 of knob 74 include no opening, such as slot 38 in knob 34. Instead, knob 74 is provided at a single predetermined circumferential position on peripheral side walls 82 with an indicator mark 84. Rotation of knob 74 to orient indicator mark 84 toward catch 72 on edge 76 brings knob 74 into the open position thereof. The interaction of catch 72 and knob 74 to effect closure of container 60 will be better understood by reference to the balance of the figures.

Figure 10:
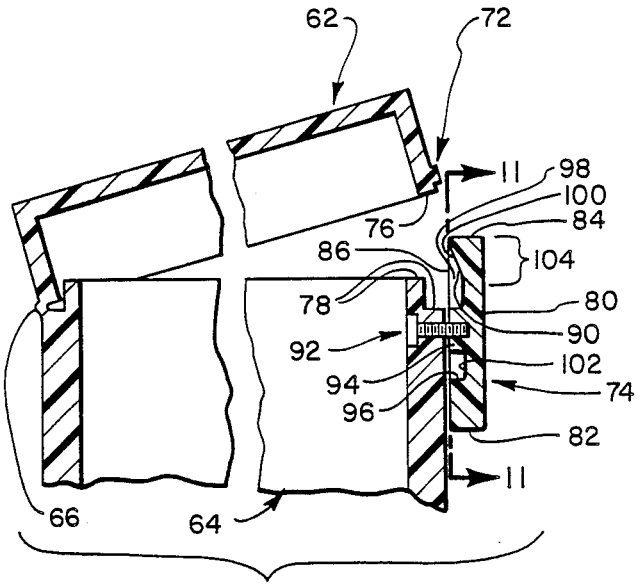
FIG. 10 is a cross-sectional elevation view of the clasp shown in FIG. 9.
Figure 11:
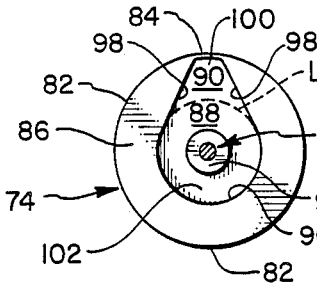
FIG. 11 is a cross-sectional elevation view of the knob and catch of the clasp shown in FIG. 10 taken along section line 10—10 shown therein.

In FIGS. 10 and 11 taken together, it will be seen that the underside 86 of knob 74, which is adjacent to second portion 64 of container 60, has formed therein a centrally located recess 88 and a radially disposed catch channel 90.

Knob 74 is secured to container 70 by way of example with a threaded pin 92 which extends through second portion 64 of container 60 and through recess 88. Toward this end, a depending boss 94 is formed within recess 88 and provided with cooperating threading. In this manner knob 74 is rendered rotatable about the longitudinal axis of pin 92. Threaded pin 92 is, however, only typical of the many structures by which a knob, such as knob 74, could be rotatably attached to the container with which it is used.

As best appreciated in FIG. 11, recess 88 is generally circular, having walls 96 that are concentric with peripheral sidewalls 82 and with the rotation of knob 74. For the sake of defining with clarity the boundaries of recess 88, a dashed line L has been included in FIG. 11 designating the hypothetical location of the portion of walls 96 eliminated at the juncture between recess 88 and catch channel 90.

Catch channel 90 extends radially from recess 88 to a point interior of the periphery of knob 74. Indicator mark 84 is located on peripheral sidewall 82 at a point corresponding to the closest approch of catch channel 90 to peripheral sidewalls 82. As shown in FIG. 11, walls 98 of catch channel 90 are tangential to walls 96 of recess 88. Alternatively, however, catch channel 90 could take any number of configurations, including that of a conventional, radially oriented, parallel-sided passageway formed in underside 86 of knob 74 to extend from recess 88 to a point just short of indicator mark 84 on peripheral sidewall 82.

Catch channel 90 has a roof 100 which is shown as being inclined relative to top surface 80 of knob 74, so that the depth of catch channel 90 diminishes continuosly with the distance from the rotational center of knob 74 defined by threaded pin 92. Such a configuration for roof 100 is, however, not absolutely essential, as the roof of catch channel 90 could with roof 102 of recess 88 be parallel to top surface 80 of knob 74. Consistent with the teachings of the present invention relative to clasp 70, it would only be necessary that such a roof for catch channel 90 terminate short of peripheral sidewall 82, in which case channel 90 could end abruptly rather than taper to an end.

Being rotatably mounted to second portion 64 of container 60, knob 74 is shown in FIG. 10 as having been rotated into the open position thereof in which catch channel 90 and indicator mark 84 are oriented toward catch 72. An overhanging portion 104 of knob 74 extends beyond edge 78. In the open position of knob 74, overhanging portion 104 includes portions of catch channel 90. Thus, in FIG. 10 catch channel 90 extends with projecting portion 104 of knob 74 beyond edge 78 of second portion 64 of container 60.

In the open position of knob 74, catch 72 enters catch channel 90 when first and second portions 62, 64, respectively, of container 60 are pivoted about hinge 66 into the closed position of container 60. How this occurs without benefit of catch channel 90 extending through peripheral sidewall 82 is best understood by reference to FIG. 12 in which edge 76 is in contact with edge 78 and container 60 is in its closed condition.

Figure 12:
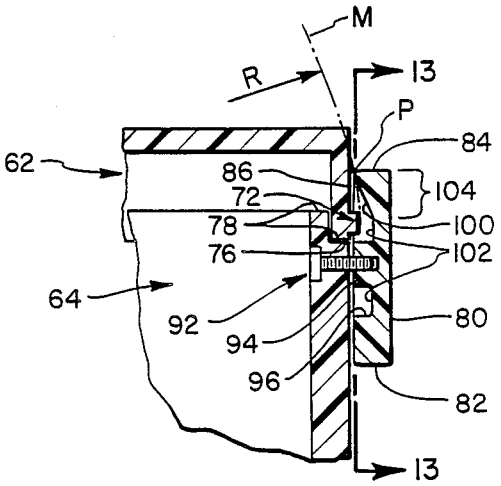
FIG. 12 is a cross-sectional elevation view similar to that shown in FIG. 10 in which the catch of the clasp is within the knob thereof.

There the path of travel of catch 72 as first portion 62 of container 60 is pivoted about hinge 60 has been indicated in phantom by line M as being an arc of radius R centered at hinge 60 (not shown in FIG. 12). In opening container 70, the rotation of first portion 62 thereof upwardly out of the position shown in FIG. 12 moves catch 72 along line M. In the process, catch 72 is retracted laterally to the left in that figure, away from knob 74. Eventually, catch 72 will have been drawn sufficiently away from knob 74 in a direction normal to underside 86 thereof to clear the edge of peripheral sidewall 82 closest to container 60. In FIG. 12, this relationship of parts is reached at point P on line M. Continuing upwardly along line M, catch 72 emerges from beneath knob 74.

Figure 13:
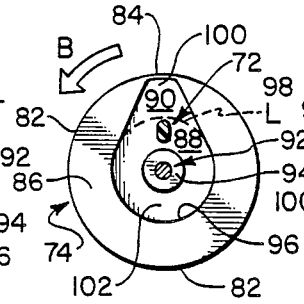
FIG. 13 is a cross-sectional elevation view of the clasp shown in FIG. 12 taken along section line 13—13 shown therein.

The process of receiving catch 72 in catch channel 90 involves a mere reversal of this process. The relationship of parts shown in FIG. 12 may more clearly be understood by reference to FIG. 13, where catch 72 can be seen to rest within dotted line L designating the boundary of recess 88. Rotation of knob 74 in either direction from the open position thereof illustrated will capture catch 72 within the combination of recess 88 and catch channel 90. By way of illustration, rotation of knob 74 in the direction shown by arrow B in FIG. 13 will bring the components of clasp 70 in FIG. 13 into the relationship depicted in FIG. 14.

Figure 14:
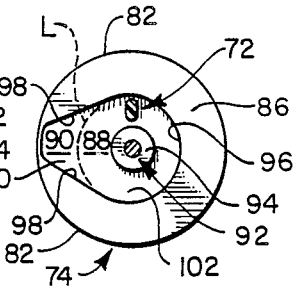
FIG. 14 is a cross-sectional elevation view similar to that shown in FIG. 13 in which the knob of the clasp illustrated has been rotated out of the open position thereof.
Figure 15:
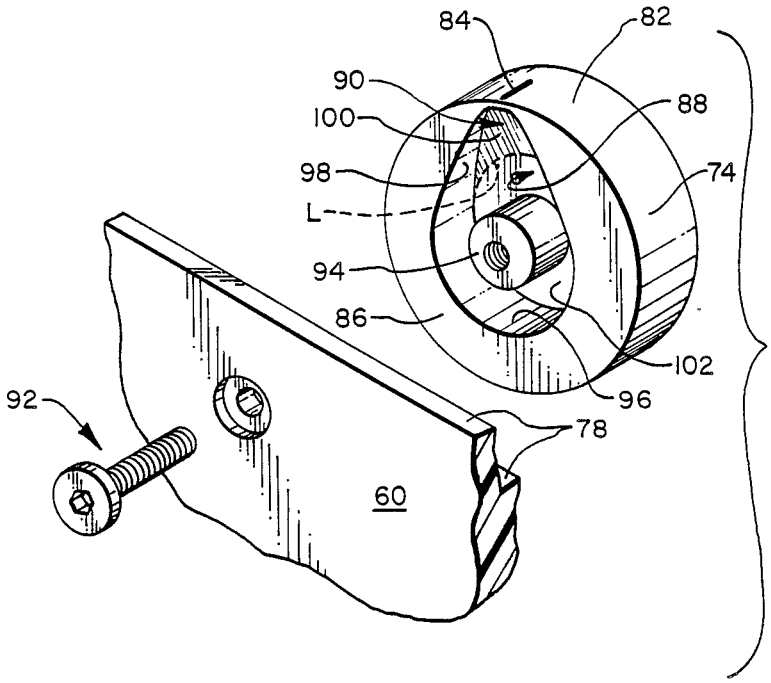
FIG. 15 is a disassembled perspective view of the underside of the knob of the clasp shown in FIGS. 9–14.

In FIG. 14 catch channel 90 has been rotated to the side of knob 74. Peripheral sidewall 82 of knob 74 is thus directly above catch 72 where it precludes the upward movement catch 72 out of recess 88. In this manner the closure of container 60 is secured. Rotation of knob 74 into the open position thereof with catch channel 90 directly above catch 72 will permit the release of catch 72 and the opening of container 60. For additional clarity of disclosure, FIG. 15 depicts in perspective underside 86 of knob 74 and recess 88 and catch channel 90 formed therein.

Clasp 70 exhibits all of the advantages described above in relation to clasp 30. In addition thereto, however, clasp 70 exhibits a more streamlined appearance and is less susceptible to inadvertent opening due to accidental impact. This is due to the absence of any break in peripheral sidewalls 82 of knob 74.

On the other hand, unlike clasp 30, clasp 70 requires that the portion of the container bearing the catch for clasp 70 must be hinged or otherwise pivoted into position behind the knob thereof in the manner described in detail in relation to FIG. 12. In clasp 30 the presence of an opening, such as slot 38, in the peripheral sidewalls of knob 34 enable the catch associated with clasp 30 to enter the space behind knob 34 travelling in a linear, translated line of travel. In relation to clasp 70, however, this is not a possibility.

Accordingly, if it is desired to utilize clasps, such as clasp 70, to secure the closure of a container having a lid and receptacle portion which are not attached, it will be necessary to utilize a pair of clasps, such as clasp 70, on each of two opposite sides of the container. Generally, the knobs associated with such clasps are both mounted on the same portion of the container. Both knobs must are placed in the open positions thereof. A first of the catches is inserted behind its corresponding knob while holding the two portions of the container at an angle to each other. Then the opposite edges of the container are pivoted about the first knob and catch to enable the second catch to pass behind its knob. Both knobs can then be rotated out of their closed position to secure closure.

While the embodiments of clasps disclosed herein have been utilized in relation to rigid box-like containers, the concepts and structure disclosed have far wider applicability. Clasps such as clasp 30 or 70 can be used to effect the closure of larger containers, such as files, trunks, cupboards, and closets. Under appropriate circumstances doors and windows may be securable by devices incorporating the present teachings. In addition, the clasps disclosed herein will function to secure the closure of nonrigid wrappings and containers, provided that the items housed therein or wrapped thereby are adequately bulky to ensure that the closure or wrapping thereof results in a persistent tension in the container or wrapping. Such tension is generally necessary to keep the catch of the present invention in the knob thereof.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A clasp for releasably effecting secure closure of a container having first and second portions pivotally attached to each other at a common edge, the first and second portions being pivotable into mating engagement in a closed position, said clasp comprising:

(a) a catch fixed on the outside of the first portion of the container adjacent an edge thereof remote from the common edge;

(b) a knob rotatably mounted on the outside of the second portion of the container adjacent an edge thereof remote from the common edge at a position opposite said catch when said first and second portions are in the closed position thereof, a projecting portion of said knob interior to the peripheral circumference thereof projecting beyond the edge of the second portion of the container to overlap the first portion of the container when the first and second portions are in the closed position thereof, and the side of said knob adjacent the container defining an underside of said knob;

(c) a recess centrally formed in said underside of said knob; and (d) a catch channel formed in said underside of said knob communicating with said recess and extending therefrom radially outwardly into said projecting portion of said knob to terminate at a radially extreme point within said projecting portion;

said knob being rotatable into an open position in which said catch channel is oriented normal to and extends beyond the edge of the second portion of the container, said catch channel in said open position of said knob being enterable by said catch when the first and second portions of the container are pivoted into the closed position thereof;

said recess and said catch channel having sidewalls so configured that rotation of said knob into a position out of said open position when said first and second portions are in the closed position captures said catch in said recess and of said catch channel to preventing pivoting of the first and second portions out of the closed position thereof.

2. A clasp as recited in claim 1, wherein said walls of said recess are concentric with the rotation of said knob.

3. A clasp as recited in claim 1, wherein said walls of said recess are normal to the outside of the container.

4. A clasp as recited in claim 1, wherein the walls of said catch channel are tangential to the walls of said recess.

5. A clasp as recited in claim 1, wherein said recess is generally circular.

6. A clasp as recited in claim 1, wherein said knob is generally cylindrical.

7. A clasp as recited in claim 6, wherein said recess is concentric with the periphery of said knob.

8. A clasp as recited in claim 1, wherein said knob is secured to the container by a pin that passes through said recess.

9. A clasp as recited in claim 1, wherein said knob is rotatable in either angular direction from said open position thereof.

10. A clasp as recited in claim 1, wherein the distance from any point on the roof of said catch channel to the plane of said underside of said knob defines the depth of said catch channel associated with said any point, and said depth of said catch channel diminishes continuously with the distance of said any point from the center of rotation of said knob.

* * * * *